US005353531A

United States Patent [19]

Doucette

[11] Patent Number: 5,353,531

[45] Date of Patent: Oct. 11, 1994

[54] DITCH DIGGING APPARATUS AND METHOD

[76] Inventor: Rene P. Doucette, 2537 Evergreen Dr., Penticton, British Columbia, Canada, V2A 7Y2

[21] Appl. No.: 933,177

[22] Filed: Aug. 21, 1992

[51] Int. Cl.[5] ..... E02F 3/00

[52] U.S. Cl. ..... 37/444; 37/411; 37/379

[58] Field of Search ..... 37/103, 141 R, 115, 37/118 R, 118 A, 107, 71, 80 R, 80 A; 414/722

[56] References Cited

U.S. PATENT DOCUMENTS

| | | | |
|---|---|---|---|
| 1,357,359 | 11/1920 | Specht | 37/103 |
| 1,545,943 | 7/1925 | Crane . | |
| 1,638,099 | 8/1927 | Rorabeck . | |
| 2,972,425 | 2/1961 | Anderson et al. . | |
| 3,958,347 | 5/1976 | Heitman . | |
| 4,111,320 | 9/1978 | Breeding . | |
| 4,314,789 | 2/1982 | Luigi | 37/103 X |
| 4,691,455 | 9/1987 | Newman . | |
| 4,704,811 | 11/1987 | Jefferson | 37/141 R X |
| 4,939,855 | 7/1990 | McCreary, Jr. | 37/103 |

*Primary Examiner*—Randolph A. Reese
*Assistant Examiner*—Spencer Warnick
*Attorney, Agent, or Firm*—George A. Seaby

[57] ABSTRACT

A bucket for digging a ditch by moving the bucket longitudinally of the proposed ditch, rather than in the usual transverse direction, includes a top wall, a bottom wall, a rear wall and a pair of side walls diverging forwardly from the rear wall to an open front end of the bucket, one of the side walls being planar and defining a sharp corner with the bottom wall, the other side wall having a curved bottom end whereby a round bottom ditch can be formed by dragging the sharp corner through the soil longitudinally of the proposed ditch in a first pass, and then making a second pass through the soil using the curved end of the bucket.

4 Claims, 4 Drawing Sheets

DITCH DIGGING APPARATUS AND METHOD

BACKGROUND OF THE INVENTION

1. Field of the Invention

This invention relates to a bucket for use on a mechanical ditch digging apparatus.

More specifically, the invention relates to a bucket for use on an apparatus of the Gradall (trademark) type or a backhoe equipped with an extensible boom, which can be rotated through 180° around its longitudinal axis.

2. Discussion of the Prior Art

When a road is cut in the side of a hill or mountain, drainage ditches are usually required to carry away water flowing down the hill or mountain towards the road. Such ditches usually have a V-shaped cross-sectional configuration which tends to concentrate water into a small area of the ditch increasing the likelihood of erosion. With a view to reducing or preventing erosion, it is preferable that the bottom of drainage ditches be round so that the flow of water is spread over a great area.

Round bottom ditches have conventionally been cut using backhoes or other digging apparatuses. The apparatus is parked on the shoulder of a road, the boom is extended toward the proposed ditch area, and a square sided bucket attached to the outer end of the boom is extended toward such area. The bucket is dropped into the soil and curled inwardly and the boom is simultaneously retracted. The process is repealed two or three times. During the first pass or passes, the soil is cut, and the last pass serves to clear the cut soil. Completion of the passes may be considered as a cycle, and with each cycle a ditch segment the width of the bucket is completed. Conventional buckets are approximately five feet wide, and accordingly each cycle produces approximately five feet of ditch. At the usual speeds, a round bottomed ditch can be produced at a rate of approximately 50 lineal meters per hour.

The conventional round bottom ditch digging method described above suffers from the disadvantage that the simultaneous curl and retraction of the boom must be controlled very accurately which can be difficult for an inexperienced operator. If the curl and retraction are not accurately controlled, the ditch may be overcut resulting in undermining and premature ditch erosion. Moreover, in order to cut a round bottom ditch using the conventional method, the body of the digging apparatus must be swung out into the roadway which results in a hazard to traffic passing on the roadway.

GENERAL DESCRIPTION OF THE INVENTION

The object of the present invention is to provide a solution to the problems associated with the conventional method of producing a round bottomed ditch.

Accordingly, the present invention relates to a bucket for use on a mechanical ditch digging apparatus comprising top wall means; bottom wall means; rear wall means extending between said top wall means and said bottom wall means; first side wall means extending forwardly from one end of said rear wall means and interconnecting one end of said top wall means and one end of said bottom wall means; and second side wall means extending forwardly from the other end of rear wall means and interconnecting the other end of said top wall means and the other end of said bottom wall means; said top wall means, bottom wall means and side wall means having front edges defining an open front end for receiving earth; said first side wall means defining an angular corner with said one end of said bottom wall means, whereby the bracket can be dragged through the earth with the angular corner extending downwardly to form an angular ditch; and said second side wall means defining a convex corner at said other end of said bottom wall means, whereby, when the bucket is rotated 180° around an axis extending between said side walls, the convex corner extends downwardly for dragging through the angular ditch to form a round bottom ditch.

BRIEF DESCRIPTION OF THE DRAWINGS

The invention will be described with reference to the accompanying drawings, which illustrate a preferred embodiment of the invention, and wherein.

DESCRIPTION OF PREFERRED EMBODIMENT

Figure 1:
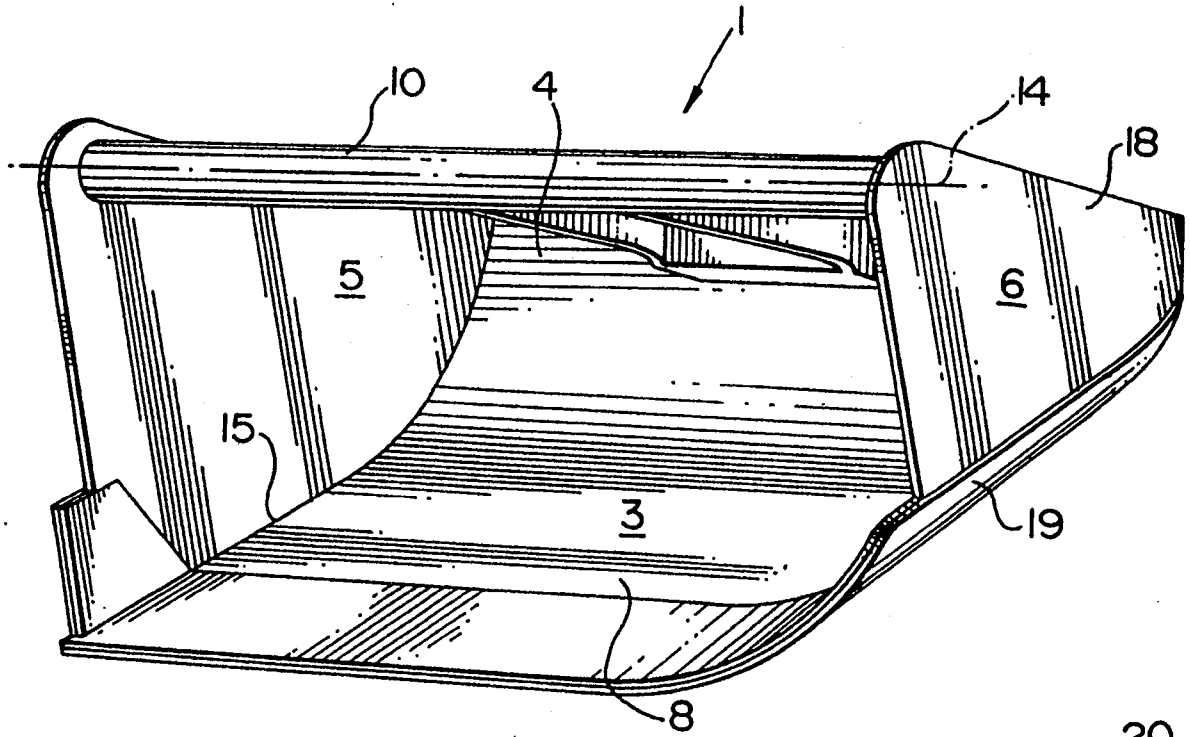
FIG. 1 is a perspective view of a bucket in accordance with the present invention.
Figure 3:
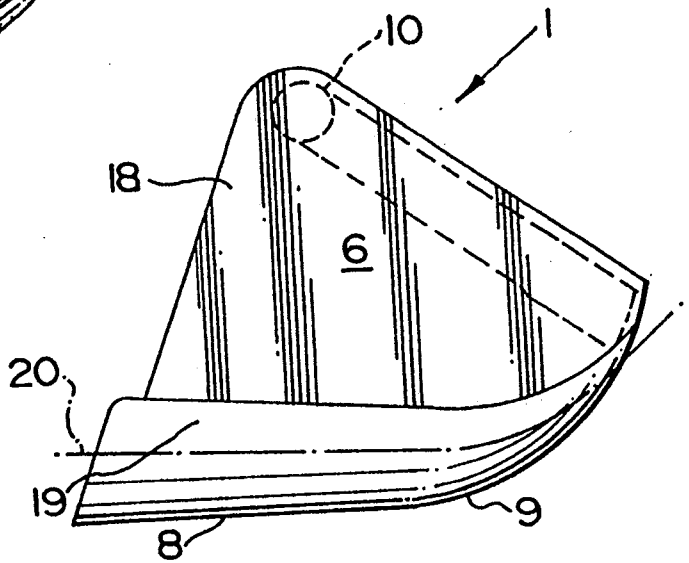
FIG. 3 is a side elevational view of the bucket of FIG. 1.
Figure 2:
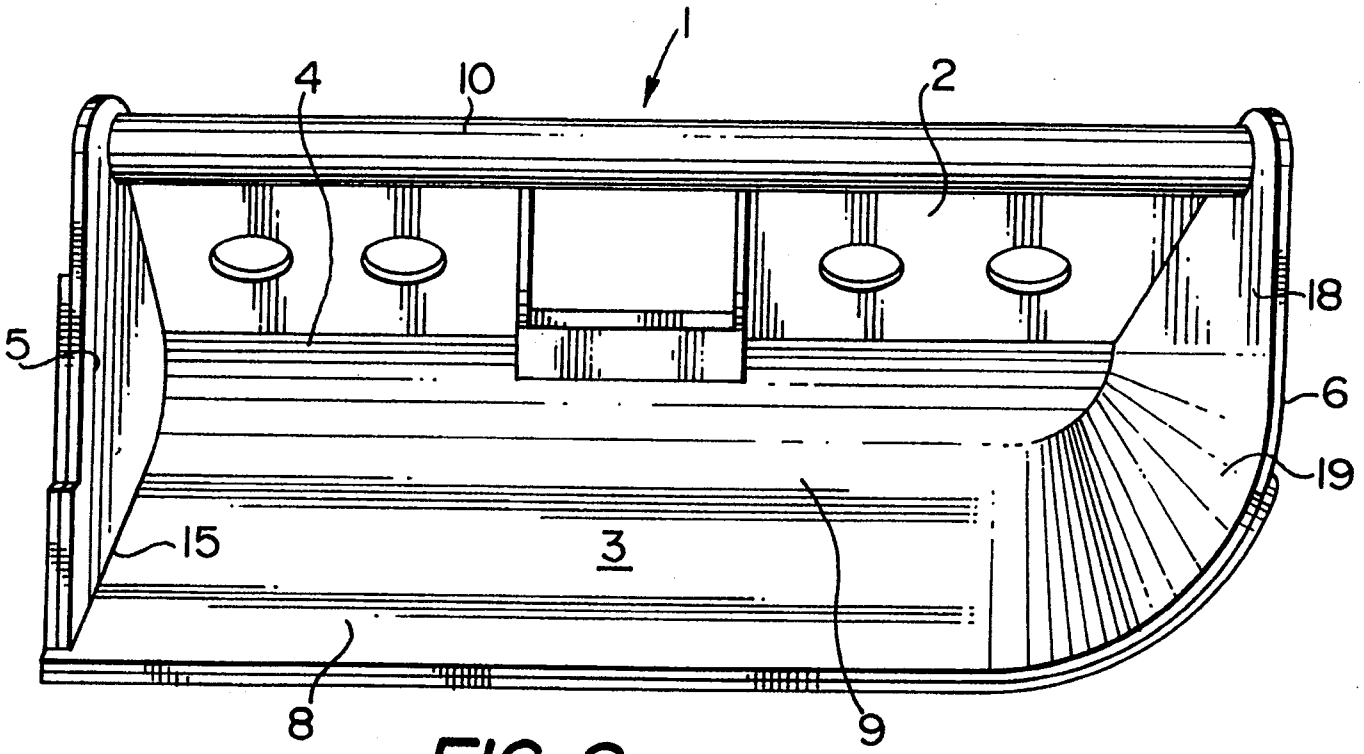
FIG. 2 is a front elevational view of the bucket of FIGS. 1 and 2.

With reference to FIGS. 1 to 3, a ditch digging bucket generally indicated at 1 in accordance with the present invention includes a top wall 2, a bottom wall 3, a rear wall 4, and a pair of side walls 5 and 6. The top wall 2, the bottom wall 3 and the side walls 5 and 6 extend forwardly from the rear wall 4, and the free front edges thereof define an open front end or mouth. The rear wall 4 is integral with the bottom wall 3, the two walls curving downwardly and forwardly from the straight, planar top wall 2 of the bucket.

As best shown in FIGS. 2 and 3, the bottom wall 3 includes a reinforced, flat, planar portion 8 at the open front end of the bucket and an arcuate rear portion 9 flowing smoothly into the arcuate rear wall 4. A crossbar 10 extends across the front end of the top wall 2 between the side walls 5 and 6 for connecting the bucket to a ditch digging vehicle or apparatus 12 (FIGS. 4 and 5) of the type including an extensible boom 13, which can be rotated around its own longitudinal axis. It must also be possible to rotate the bucket 1 around the longitudinal axis 14 of the crossbar 3.

The side wall 5 is flat and planar, and defines an angle of 90° with each of the top wall 2 and the bottom wall 3. Thus, there is an angular corner 15 between the side wall 5 and the bottom wall 3 which is used to cut a generally V-shaped or angular ditch 16 (FIG. 4) in the ground when the bucket 1 is dragged through the soil with the corners 15 extending downwardly. The side wall 5 defines an angle with the rear wall 4 in excess of 90°. Thus, the side wall 5 slopes upwardly from the mouth of the bucket when the corner 15 is in the downward cutting position shown in FIG. 4 to prevent skidding of the outer surface of such side wall over the soil.

Figure 5:
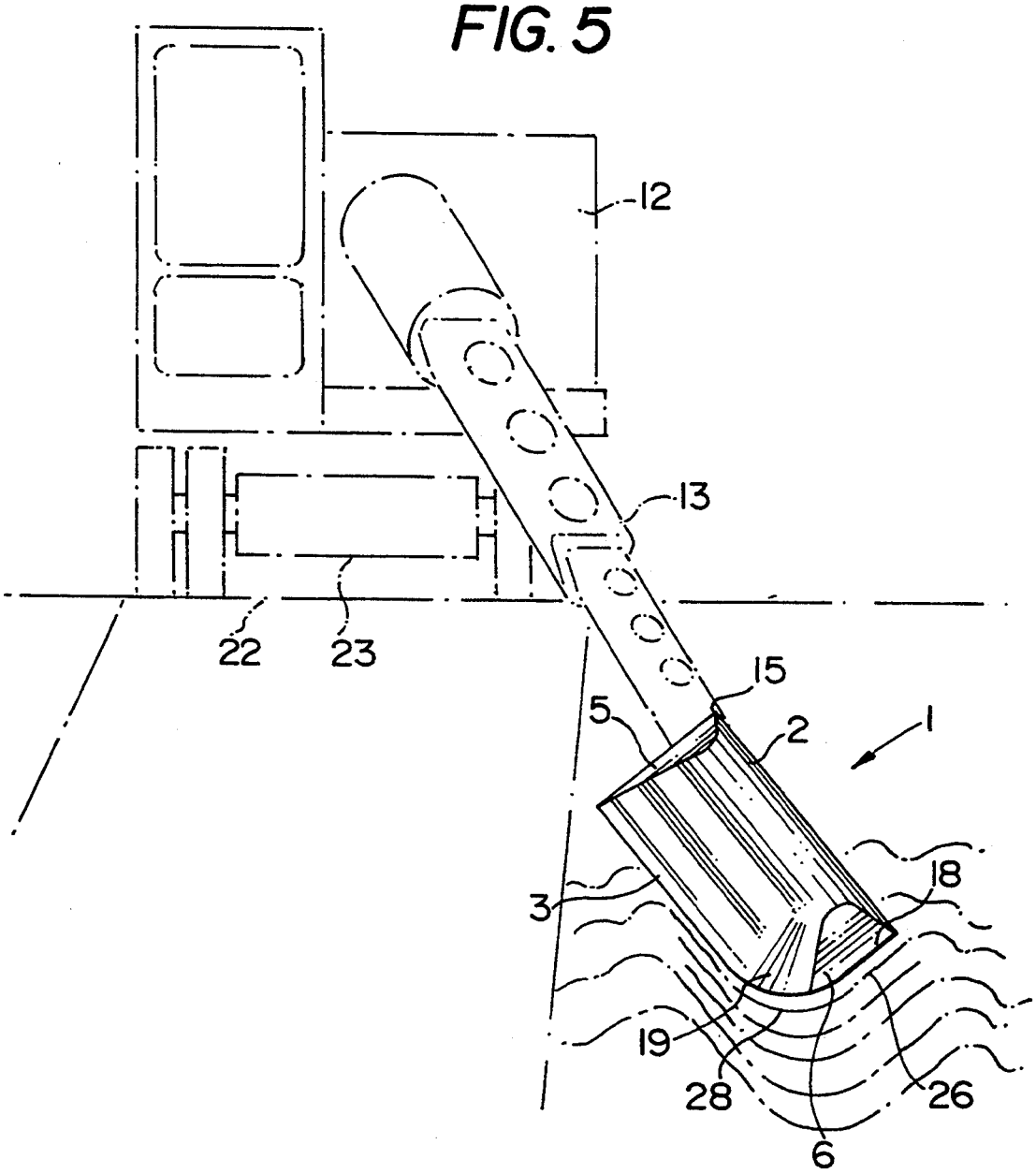

The other side wall 6 includes a flat, planar portion 18 and a curved portion 19. There is an angle of 90° between the flat portion 18 and the top wall 2. The curved portion 18, which is convex extends outwardly form the rear wall 4 between the flat portion 18 of the side wall 6 and the bottom wall 3 defining a convex arc or corner on the exterior of the bucket. At the mouth of bucket, the front, free edge of the curved portion 19 extends through an arc of 90°. The curved portion 19 tapers rearwardly from the mouth of the bucket to the rear wall 4. As shown in FIG. 3, the longitudinal axis 20 of the curved portion 19 follows the contour of the upwardly curving bottom wall 3 of the bucket. The side wall 6, like the side wall 5, defines an angle with the rear wall 5 in excess of 90° to prevent skidding of the outer surface of the side wall 6 over the soil when the bucket is in the downward cutting position (FIG. 5). The angel between the side wall 6 and the rear wall 4 is greater than the angle between the side wall 5 and the rear wall 4.

Figure 4:
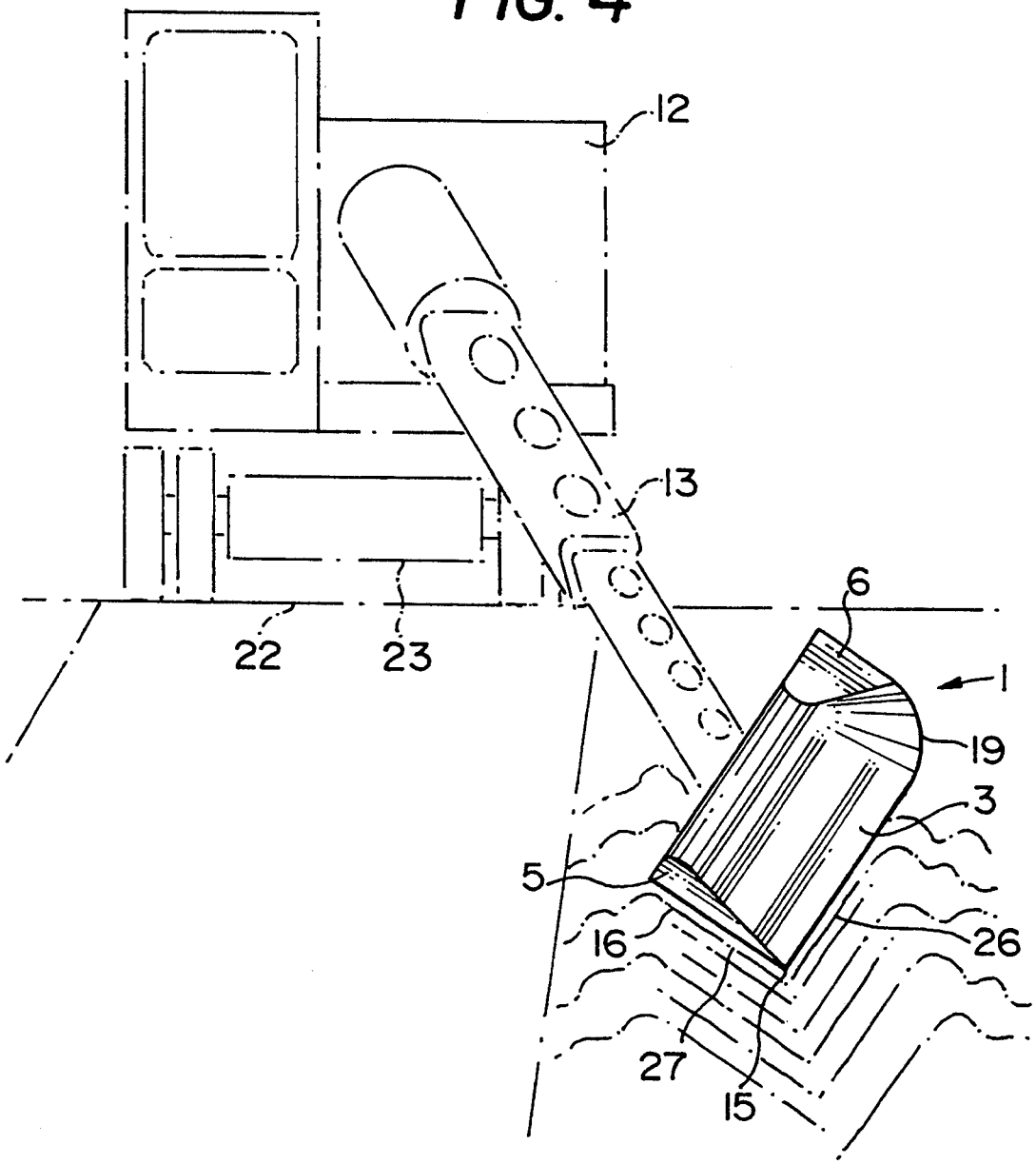
FIGS. 4 and 5 are schematic end views of a ditch digging or excavating machine with the bucket of FIGS. 1 to 3 mounted thereon.

Referring to FIGS. 4 and 5, in operation the vehicle 12 is positioned on one side of a roadway 22 so that the axles 23 (one shown) of the vehicle are perpendicular to the longitudinal axis of the roadway. In this position, the boom 13 of the vehicle 12 can be extended at an angle to the longitudinal axis of the roadway with only a small portion of the vehicle extending into the roadway.

The boom 13 is fully extended and the bucket 1 is rotated so that the angular corner 15 extends downwardly towards the soil. The boom 13 is actuated to push the bucket 1 downwardly into the soil, and the boom is retracted to cut a V-shaped ditch 16. On many machines, e.g. a Gradall, the boom 13 can be retracted up to twelve feet, and accordingly an approximately twelve feet long V-shaped ditch 16 can be cut during a single pass of the bucket 1.

With reference to FIG. 5, once the V-shaped ditch 16 has been cut, the bucket 1 is removed from the soil and the boom 13 is fully extended. The bucket 1 is rotated through 180°, so that the curved portion 19 of the side wall 6 extends downwardly. The outer end of the boom 13 is lowered so that the flat portion 18 of the side wall 6 is parallel to and adjacent one side 26 of the ditch 16. In this position, the other side 27 of the ditch is in the path of the bucket 1 and the curved portion 19 of the side 6 is positioned to cut a round bottom 28 in the ditch 16. The boom 13 is retracted to cut an approximately twelve feet long round bottom ditch, i.e. to clear away a portion of the side 27 of the ditch and to form the round bottom 28.

It will be appreciated that a length of round bottom ditch is produced with only two passes over the soil; namely a first pass to cut a length of V-shaped ditch and the second pass to form the length of round bottom ditch. The two passes constitute one cycle in the formation of the length of ditch, and thus one length of ditch is formed upon completion of each cycle. The length of ditch formed during each cycle is determined by the amount by which the boom can be retracted which for most Gradall units is twelve feet. Therefore the completion of each cycle produces approximately twelve feet of ditch.

The inventor has found that using this method a ditch may be formed at the rate of 100 lineal meters/hour, which is an improvement over existing ditch digging methods employing four operations per cycle and producing ditches at a rate of 50 linear meters/hour. It will be appreciated that by using the disclosed bucket in the disclosed method, the number of operations per cycle is reduced and the length of ditch produced by each cycle is increased over methods used heretofore. This, of course, enables a ditch to be produced faster and more efficiently than with heretofore known ditch digging buckets and methods.

What is claimed is:

1. A bucket for use on a mechanical ditch digging apparatus comprising top wall means; bottom wall means; rear wall means integral with said bottom wall means, the rear wall means and the bottom wall means defining a curve extending downwardly and forwardly from a rear edge of said top wall to an open front end of the bucket; first side wall means extending forwardly from one end of said rear wall means and interconnecting one end of said top wall means and one end of said bottom wall means; and second side wall means extending forwardly from the other end of said rear wall means and interconnecting the other end of said top wall means and the other end of said bottom wall means, said first and second side wall means diverging forwardly from said rear wall means; said top wall means, bottom wall means and side wall means having front edges defining an open front end for receiving earth; said first side wall means defining an angular corner with said one end of said bottom wall means, whereby the bucket can be dragged through the earth with the angular corner extending downwardly to form an angular ditch; and said second side wall means defining a convex corner at said other end of said bottom wall means, said convex corner tapering rearwardly toward said rear wall means, whereby, when the bucket is rotated 180° around an axis extending between said side walls, the convex corner extends downwardly for dragging through the angular ditch to form a round bottom ditch.

2. A bucket according to claim 1, wherein said second side wall means includes a straight planar top portion and a convex lower portion defining said convex corner.

3. A bucket according to claim 1, wherein said convex corner defines an arc extending through 90° at the open front end of the bucket.

4. A bucket according to claim 1, wherein each said first and second side wall means defines an angle with said rear wall means in excess of 90°, the angle between said second side wall means and said rear wall means being greater than the angle between said first side wall means and said rear wall means.

* * * * *